US007334644B1

(12) United States Patent
Ozment

(10) Patent No.: US 7,334,644 B1
(45) Date of Patent: Feb. 26, 2008

(54) METHOD FOR FORMING A BARRIER

(76) Inventor: Alden Ozment, 116 Hunter Creek Dr., Longview, TX (US) 75602-1318

( * ) Notice: Subject to any disclaimer, the term of this patent is extended or adjusted under 35 U.S.C. 154(b) by 0 days.

(21) Appl. No.: 11/691,935

(22) Filed: Mar. 27, 2007

(51) Int. Cl.

| | |
|---|---|
| ***A62C 2/06*** | (2006.01) |
| ***A62C 2/00*** | (2006.01) |
| ***A62C 3/02*** | (2006.01) |
| ***A62C 3/00*** | (2006.01) |
| ***A62C 5/02*** | (2006.01) |
| ***A62C 5/00*** | (2006.01) |

(52) U.S. Cl. ..... 169/46; 169/44; 169/48; 169/15; 169/64; 169/70; 239/8; 239/311; 299/12

(58) Field of Classification Search ..... 169/46, 169/15, 44, 48, 64, 70, 14, 47, 49, 54, 66, 169/68, 69; 239/8, 311, 398; 454/169; 405/129.1, 405/129.45, 129.55, 129.6; 299/12
See application file for complete search history.

(56) References Cited

U.S. PATENT DOCUMENTS

| | | | | |
|---|---|---|---|---|
| 2,710,232 A | | 6/1955 | Schmidt et al. | |
| 3,172,477 A | * | 3/1965 | Grisdale et al. | 169/64 |
| 3,186,490 A | | 6/1965 | Jamison et al. | |
| 3,440,824 A | | 4/1969 | Doolin | |
| 3,500,934 A | | 3/1970 | Magnuson | |
| 3,583,165 A | * | 6/1971 | West et al. | 405/266 |
| 3,645,337 A | | 2/1972 | Livingston | |
| 3,648,614 A | | 3/1972 | Berthmann et al. | |
| 3,817,039 A | * | 6/1974 | Stewart et al. | 405/263 |
| 3,852,967 A | | 12/1974 | Stewart et al. | |
| 3,878,897 A | | 4/1975 | Goffart | |
| 3,927,719 A | | 12/1975 | Maser | |
| 4,102,138 A | | 7/1978 | Dreker et al. | |
| 4,232,974 A | | 11/1980 | Schmidt et al. | |
| 4,437,520 A | | 3/1984 | Stoddard et al. | |
| 4,465,401 A | | 8/1984 | Stoddard et al. | |
| 4,641,711 A | | 2/1987 | Terry | |
| 4,712,945 A | * | 12/1987 | Schrimpf | 405/132 |
| 4,744,700 A | | 5/1988 | Andy et al. | |

(Continued)

FOREIGN PATENT DOCUMENTS

| | | |
|---|---|---|
| EP | 94331 | 11/1986 |

(Continued)

*Primary Examiner*—Kevin Shaver
*Assistant Examiner*—Darren Gorman
(74) *Attorney, Agent, or Firm*—Stites & Harbison, PLLC; David W. Nagle, Jr.; Robert C. Yang

(57) ABSTRACT

A method for forming a barrier to seal off a remote chamber includes the steps of: forming a borehole that communicates between a first location and the remote chamber; inserting a conduit through the borehole to extend into the remote chamber; introducing a flowable material through the conduit to the remote chamber and dispensing the flowable material from the conduit to the desired location for the barrier, the flowable material upon being dispensed producing a substantially solid, self-sustaining composition; maintaining dispensing the flowable material to produce a sufficient quantity of the self-sustaining composition to form the barrier to seal the remote chamber, while ensuring that the composition does not block the borehole from communicating between the first location and the remote chamber; and thereafter removing the conduit to allow access to the borehole.

11 Claims, 3 Drawing Sheets

U.S. PATENT DOCUMENTS

| | | | | |
|---|---|---|---|---|
| 4,900,196 | A | | 2/1990 | Bridges |
| 5,167,474 | A | * | 12/1992 | Kennedy et al. ..... 405/132 |
| 5,188,186 | A | | 2/1993 | Nash |
| 5,469,920 | A | | 11/1995 | Conti et al. |
| 5,725,327 | A | * | 3/1998 | Hussey et al. ..... 405/132 |
| 5,803,172 | A | | 9/1998 | Rajkovich |
| 6,082,828 | A | | 7/2000 | Bailey et al. |
| 6,322,293 | B1 | | 11/2001 | Stephens |
| 6,419,324 | B1 | * | 7/2002 | Kennedy et al. ..... 299/12 |
| 7,096,965 | B2 | | 8/2006 | Ozment |
| 7,104,336 | B2 | | 9/2006 | Ozment |

FOREIGN PATENT DOCUMENTS

| | | |
|---|---|---|
| JP | 06033697 | 2/1994 |
| JP | 07171226 | 7/1995 |

* cited by examiner

METHOD FOR FORMING A BARRIER

BACKGROUND OF THE INVENTION

1. Field of the Invention

This invention relates to the method of forming a barrier to seal off a remote chamber; specifically, for forming a gas-impermeable seal for firefighting in a confined space, such as a coal mine.

2. Description of Prior Art

Fighting a coal mine fire is dangerous and costly. Because the fire is typically in a confined space of the mine, there are numerous unsafe conditions including: mine subsidence, extreme heat from the fire, and explosive and noxious combustion gases. Specialized safety and firefighting equipment adapted for the unsafe conditions is needed to safely fight the fire. In addition, the area involved in a fire is normally sealed off from non-involved areas by the placement of barriers. In many cases, this involves personnel entering the mine to erect a brattice or other sealing device; exposing them to unsafe conditions. Attempts have been made to improve and make safer the conditions for fighting fires in coal mines and similar confined spaces. Such attempts include procedures for remotely sealing the involved area and remotely fighting fires in confined spaces so as to avoid exposing personnel to the dangers involved with fire fighting in confined or enclosed spaces.

One procedure for remotely fighting fires involve pumping concrete through a borehole to smother the fire. A problem with this method is that the borehole is filled with concrete, ending the usefulness of the borehole.

Another method for remotely fighting fires is to inject a fire extinguishing foam as disclosed in U.S. Pat. Nos. 7,096,965 (the '965 patent) issued on Aug. 29, 2006, and 7,104,336 (the '336 patent) issued on Sep. 12, 2006, both to the present inventor. In the '965 and '336 patents, an initial step involved in fighting fires is to seal off the area of the mine on fire to prevent the spread of the fire and to control the disposition of the fire suppressant. This method can utilize boreholes to deliver the fire extinguishing foam.

With a typical borehole around a hundred feet to thousands of feet deep, it is expensive to drill, with a typical borehole costing approximately $100,000. Boreholes are even more expensive to fill with concrete, costing approximately $250,000. Thus, there is a need for remotely fighting fires in a coal mine by using the previously drilled borehole both to remotely prepare a barrier and to deliver a fire extinguishing material.

BRIEF SUMMARY OF THE INVENTION

The present invention provides a method for remotely forming a barrier to seal off a remote chamber that is involved in a fire and which permits access to the area involved in a fire for additional remote fire fighting operations.

Generally described, the method of the present invention provides an borehole that opens into the remote chamber and proximate the point at which a seal is to be formed. A conduit is then introduced through the borehole. Next, through the conduit, a flowable barrier material is introduced proximate the area to be sealed. After the barrier is formed, the conduit can be removed, so the borehole remains open for access to the fire involved area.

More specifically described, the conduit is a pipe or hose and has an elbow to direct the flow of the flowable material. The flowable material has a first component and a second component. The components are mixed with each other just prior to dispensing from the conduit to the point at which the seal is to be formed. The first component may be a urethane, phenolic, or epoxy and the second component is an activator to react with the first component to produce a foam that expands and forms a barrier that is a substantially solid, self-sustaining composition.

The invention is not limited to the preceding, and it will be further understood by reference to the following detailed description and the appended drawings and claims.

DETAILED DESCRIPTION OF INVENTION

Figure 1:
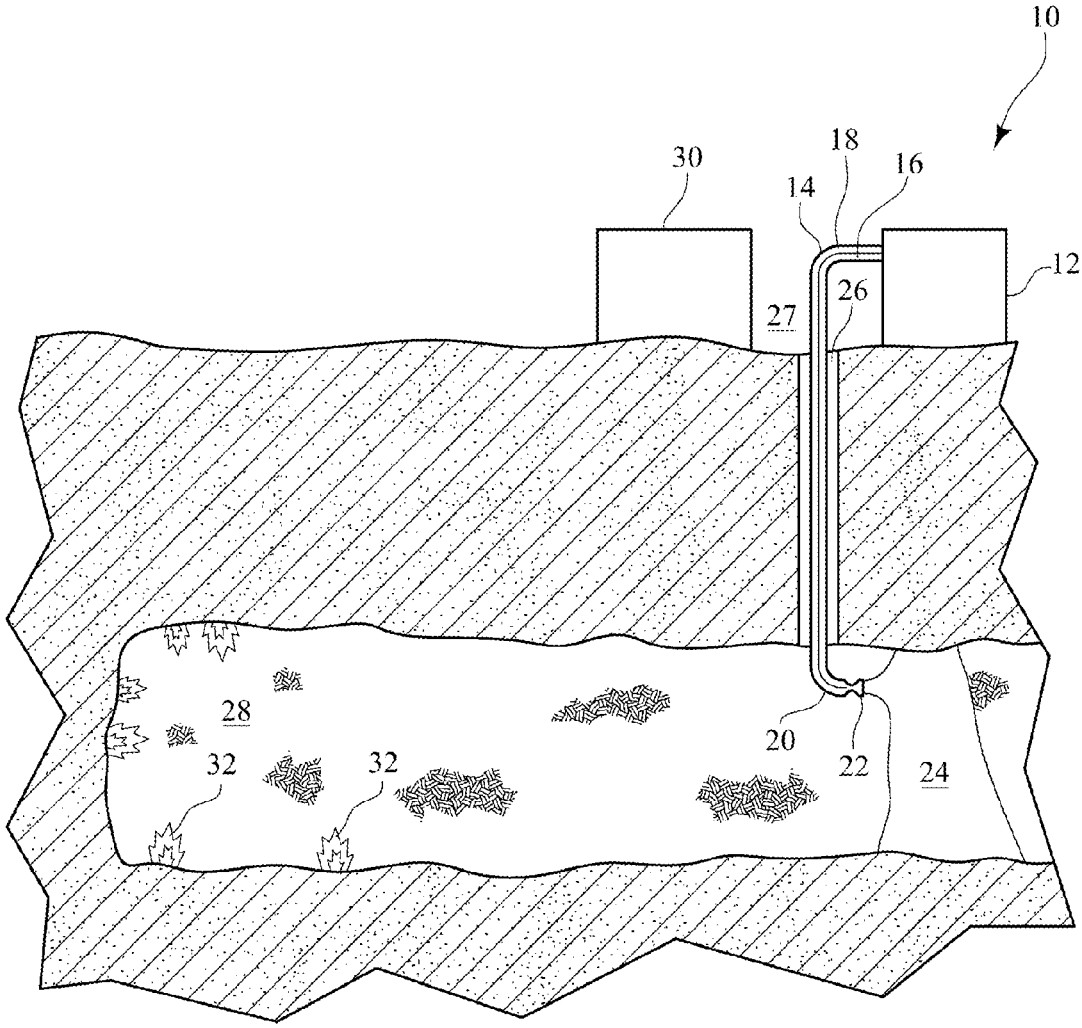
FIG. 1 is a partial sectional view illustrating a preferred arrangement for injecting a sealing foam into a mine passage.

As used herein the term "confined area" means a site having commonly shared ventilation and limited access for extinguishing a fire. The term includes total and partial confinement of the area involved in fire. In a totally confined area the portion of the combustible material comprising the confined area is essentially sealed and isolated from the surface. In a partially confined area a portion of the combustible material comprising the confined area is exposed to the surface. In partial and totally confined areas, combustion by-products can accumulate and may pose a threat to personnel attempting to extinguish such a fire. In addition, if the site is an operational site such as a working coal mine or a landfill, the presence of such a fire can result in the cessation or limitation of operations until the fire is extinguished or at least controlled which can result in severe economic and social hardship.

Fires in confined areas are difficult to extinguish because of limited access and the buildup of explosive or combustible gases that feed the fire and make extinguishing of such a fire dangerous and difficult. The confined area provides a containment area for dangerous combustion by-products. Fires occurring in partially confined areas such as a landfill and dump fires are difficult to extinguish. Likewise, fires occurring at areas where quantities of combustible materials are stored, such as storage tanks for flammable materials and tire and paper storage sites are difficult to extinguish. Although a portion of the combustible material is exposed to the surface and can be readily contacted with a fire extinguishing material, fire can continue to burn in confined areas in the interior of the combustible material away from the surface. This raises the temperature of the combustible material which can re-ignite the surface fire.

The method of forming a barrier can be used in conjunction with the method and apparatus for fighting fires in a confined area as disclosed in U.S. Pat. Nos. 7,096,965 (the '965 patent) issued on Aug. 29, 2006, and 7,104,336 (the '336 patent) issued on Sep. 12, 2006, both issued to the present inventor and which are incorporated herein by reference. The '965 and '336 patents involve isolating the fire then injecting nitrogen-enriched foam as a fire extinguishing agent.

In accordance with the invention, the first step in forming the barrier involves employing a borehole that communicates between a first location and the remote chamber proximate the desired area to be sealed. The first location is above ground or on the surface. The diameter of the borehole will depend on the use or uses require of the borehole. The diameter should allow adequate clearance of the equipment for sealing and fighting the fire in the confined space. It is anticipated that the borehole should be of a generally vertical orientation without any bends or turns; however, the borehole can be oriented in any manner as long as the borehole provides adequate access for the sealing equipment and the fire fighting equipment.

Next, a conduit for introducing foam components is inserted through the borehole. Then, the foam components, which are kept separate until mixing and dispensing, are combined together from separate lines to create a foam and the foam is dispensed to the desired sealing location to expand and form a barrier that is a substantially solid, self-sustaining composition and also is gas-impermeable and heat-resistant.

The foam components are typically a resin and an activator. The resin can be comprised of urethane, phenol, or epoxy. The resin combines together with the activator to form an urethane, phenolic, or epoxy foam that hardens over time into a substantially solid, self-sustaining composition. The composition is the fire-resistant gas-impermeable barrier. Examples of acceptable foam components include Rocsil foam, produced by Weber S. A. Micon Services, Inc. and Webac Corporation also produce suitable foam components. Other fire-resistant foams that can set to create a gas-impermeable barrier would also be acceptable. The choice of foam components can be decided on-site, depending on the condition of the confined space. For example, if the confined space is wet with water, a urethane foam component that works better in wet conditions might be chosen. Similarly, a phenolic foam component might be selected for a dry confined space.

Nevertheless, the conduit is at least a pair of lines such as pipes or hoses, for example PVC, stainless steel, or plastic, and can be of any suitable material. An elbow, a mixing chamber, and a dispenser are part of the conduit and they can be any suitable style and can be made of any suitable material similar to the conduit material. For example, the elbow can be of any commercially available elbow, made of any suitable material similar to the conduit material and can even be a simple bend in the conduit. Similarly, the mixing chamber may contain a static in-line mixer made of stainless steel for use in a stainless steel pipe. The dispenser has a nozzle and the nozzle can be any type of nozzle and is used to distribute the foam to the desired location. From the surface, the conduit can be adjusted vertically or horizontally to direct the flow of the foam.

It is preferable to ensure that an adequate barrier has been formed, while ensuring that the foam components are not wasted. There are many methods to determine if an adequate barrier has been formed. Examples of determining if an adequate seal has been formed include making a visual inspection of the barrier or measuring the ambient conditions, such as temperature, or CO or $O_2$ concentration, on either side of the barrier. However, close visual inspection would not be very safe during a fire. Safer inspection methods include placing a camera lined with a heat-resistant Kevlar® material through the borehole to provide remote inspection of the area. The camera can be a thermal imaging camera or a typical visual image camera to provide a thermal or visual image, respectively. Other methods for inspecting the barrier can include drilling another borehole further away from the fire and near the barrier, and using a camera, a CO or $O_2$ sensor, a laser, or radar system to remotely determine is an adequate barrier has been formed. Once an adequate amount of foam is delivered, the flow of the flowable material through the conduit is stopped and the foam is allowed to set into a substantially solid, self-sustaining composition. Alternatively, a set amount of the flow components can be added based on calculating the volume of the space to be sealed and an estimated amount of foam required to form the barrier.

Finally, after forming the barrier, the borehole can be used for other purposes such as for fighting fires. When the barrier is no longer needed, it can easily be removed.

Figure 2:
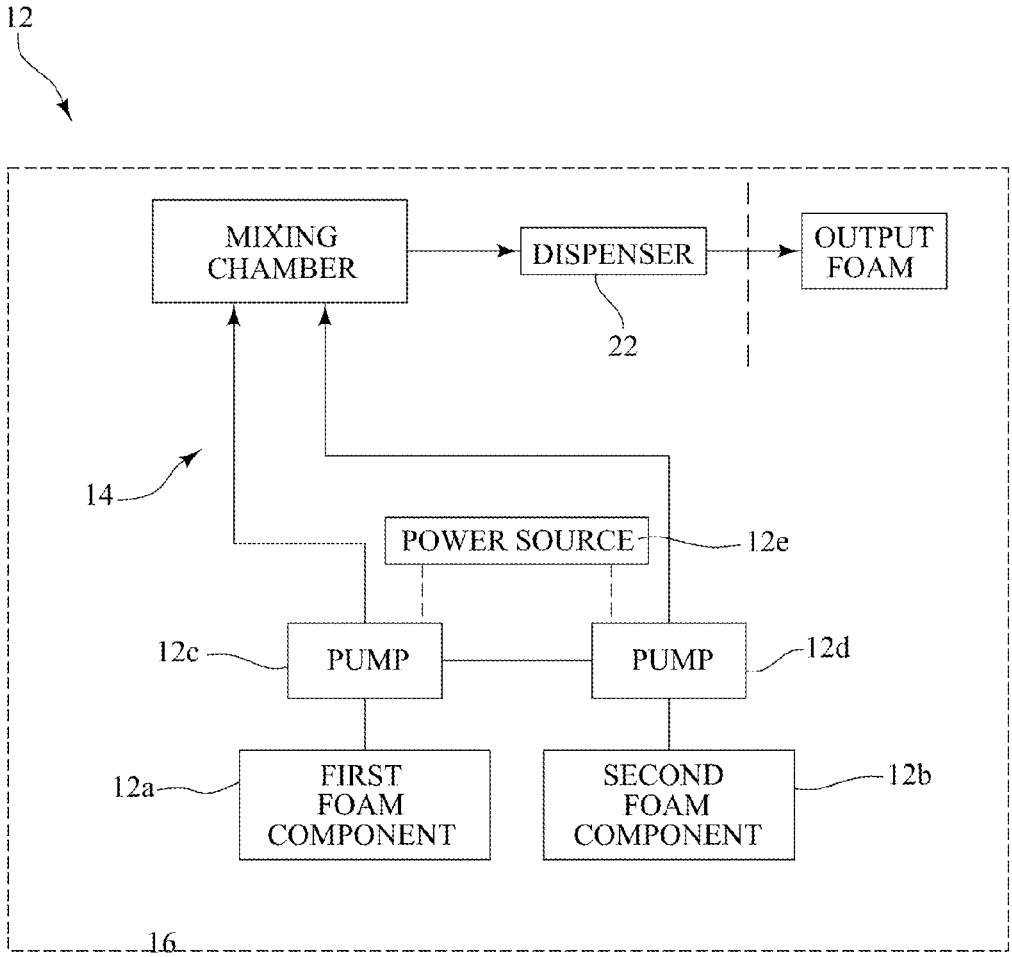
FIG. 2 is a schematic flow diagram illustrating a typical system utilizing the method of the present invention.

Accordingly, beginning with FIGS. 1 and 2, the exemplary method 10 for remotely forming a barrier to seal off a remote chamber of the present invention is shown sealing a portion of a coal mine shaft. As illustrated in FIG. 1, the method 10 initially begins with a borehole 26 that communicates between a first location 27 and the remote chamber 28. The first location 27 is typically above ground or on the surface, while the remote chamber 28 is typically the area involved in a fire 32. The borehole 26 opening to the remote chamber 28 is proximate the desired location for the barrier. By placing the borehole 26 in such a manner, the borehole 26 may be reused in fighting the fire 32, as described in the '965 and '336 patents.

Next, a conduit 14 is inserted from the first location 27 through the borehole 26 to extend into the remote chamber 28. The conduit 14 comprises a pipe or hose. The conduit 14 further comprises a first component line 16, and a second component line 18. Then, a flowable material comprising a first component 12*a* and a second component 12*b* is introduced through the conduit 14 to the remote chamber 28. The first component 12*a* is typically a resin while the second component 12*b* is typically an activator. The first resin component 12*a* is added via the first component line 16 while the second activator component 12*b* is added via the second component line 18. The component lines 16, 18 travels through the conduit 14 and meet at a dispenser 22. Preferably, the conduit 14 has a mixing chamber (not shown) disposed adjacent the dispenser 22 to mix the foam components 12*a*, 12*b* prior to discharge from the dispenser 22. The mixing chamber could contain, for example, a typical static inline mixer or other commercially available mixer. The mixer is of a conventional design and does not per se form a part of the present invention. In many cases, the foam components 12*a*, 12*b* are adequately mixed as they are introduced into and pass through the dispenser 22.

An elbow 20 is provided upstream of the dispenser 22 to aid in directing the dispersing of the mixed components 12*a* and 12*b*. The foam components 12*a*, 12*b* are maintained separately until just prior to dispersing, or if present just before the mixing chamber. The mixing chamber includes fittings (not shown) to receive the first 12*a* and second 12*b* components from the lines 16, 18 and the dispenser 22 includes a nozzle (not shown) to dispense the combined first 12*a* and second 12*b* components. The nozzle can be of any conventional design. The component lines 16, 18 allow the flowable material to be introduced from the conduit to the desired location for the barrier. The flowable material is dispensed from the conduit 14 through the dispenser 22 to the desired location to form a foam that sets into a substantially solid, self-sustaining composition 24.

Advantageously, having the dispenser 22 attached to the end of the conduit 14 in conjunction with the elbow 20 allows the foam components 12*a*, 12*b* to be dispensed away from the borehole 26, to prevent the composition 24 from blocking the borehole 26. Further, the conduit 14 can be adjusted vertically or horizontally to direct the flow of the foam.

A foam delivery system 12 is used with this method 10. The foam delivery system 12, shown in a schematic diagram in FIG. 2, is a typical commercially available delivery system with a source of the first component 12*a*, a source of the second component 12*b*, a first component pump 12*c*, a second component pump 12*d*, a power source 12*e* to provide power to the system 12, and the conduit 14.

The proportion of the first foam component 12*a* to the second foam component 12*b* can be as recommended by the manufacturer or varied as a matter of choice by those skilled in the art. For example, Weber recommends four parts resin to one part activator for the Rocsil foam. Accordingly, a higher ratio of activator to resin produces a more rigid foam while a lower ratio of activator to resin produces a more rubbery foam. Similarly, the operating conditions can be as recommended by the foam component manufacturer or varied as a matter of choice by those skilled in the art.

The foam is formed by mixing the flowable material or the components 12*a*, 12*b* together just prior to dispersion. The flowable material or the components 12*a*, 12*b* react and initiate production of foam that is allowed to expand and set or harden into the composition 24. The foam components 12*a*, 12*b* are not combined prior to dispensing to ensure the flowable material does not set or harden prior to dispensing. The flow of the first foam component 12*a* and the flow of the second component 12*b* combine to propel the foam from the dispenser 22.

The elbow 20 is shown having a 90° bend prior to the dispenser 22, but different angles may be used as long as the foam can be introduced to the area to be sealed while not obstructing the area between a fire 32 and the borehole 26. In addition, the system 12 can direct the components 12*a*, 12*b* to the desired area for forming the barrier, for example, by forming the conduit 14 in an upper and lower section so that the lower section carrying the dispenser 22 can be rotated from the first location 27. Likewise the sections can be telescoped for adjusting the vertical location of the dispenser 22.

The next step involves maintaining the dispensing of the flowable material to produce a sufficient quantity of the self-sustaining composition 24 to form the barrier to seal the remote chamber 28. When an adequate or the desired amount of foam has been dispensed, the flow of foam can be stopped and the foam hardens into the composition 24 to form the barrier. The barrier creates a desirable gas-impermeable and fire-resistant seal where no gas can be transmitted from one side of the seal to the other and vice versa.

Finally, once the barrier is formed, the conduit 14 is removed to allow access to the borehole 26. The borehole 26 can then be reused. For example, the conduit 14 can be removed from the borehole 26 to allow the borehole 26 to be used as described in the '965 and '336 patents. In some cases, the conduit does not have to be removed from the borehole 26 to reuse the borehole 26. In other words the composition 24 does not block the borehole 26 so the borehole 26 continues to communicate between the first location 27 and the remote chamber 28.

Nonetheless, the system 12 may be self-contained and adopted for mounting on structural frames to allow handling by forklifts, overhead hoists and the like for moving from place to place. The self-contained system is compact and lends itself to movement by trailer, ship or even aircraft.

Figure 3:
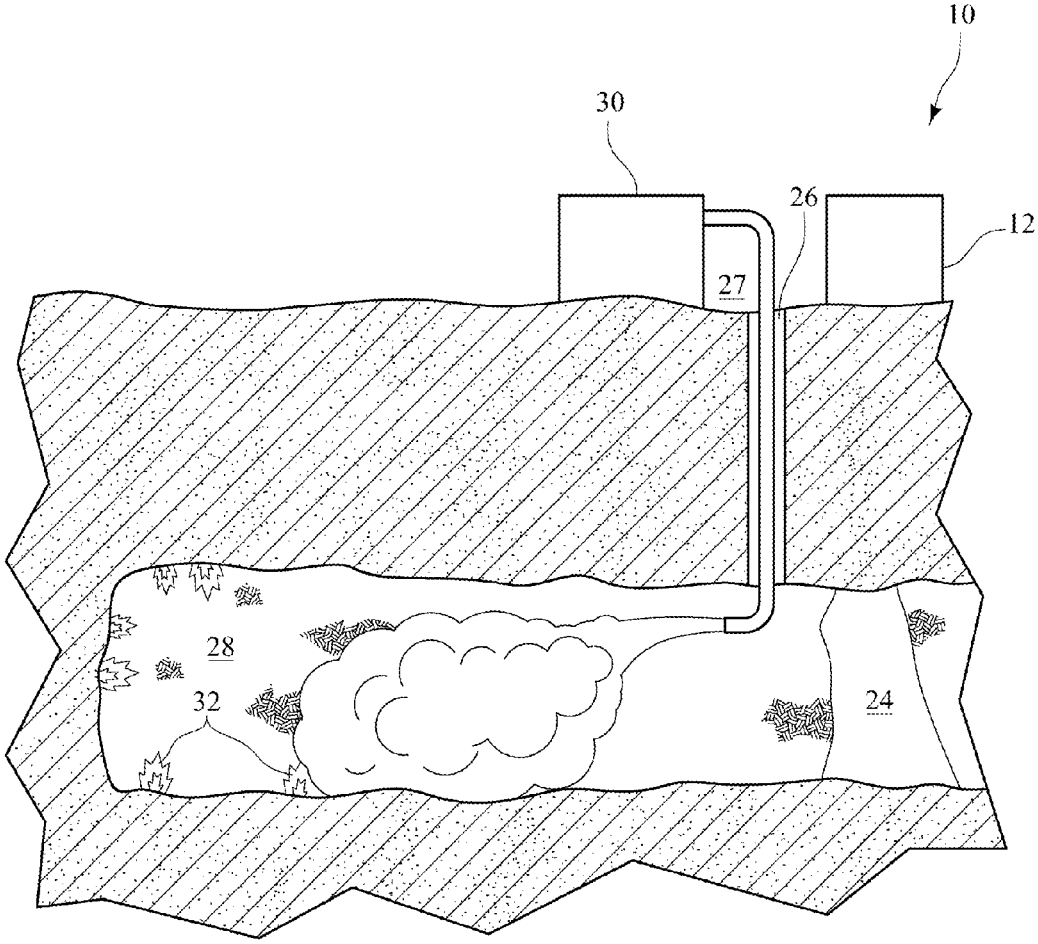
FIG. 3 is a partial sectional view illustrating a borehole being used for firefighting after sealing the mine passage.

Moving on to FIG. 3, the confined space has been sealed and the borehole 26 is being used to introduce a fire suppressant agent using a fire fighting system 30 as described in the '965 and '336 patents. Accordingly, the method for extinguishing a fire in a mine shaft comprising the steps of forming a barrier remotely to seal off an area of said mine shaft involved in the fire and uninvolved areas of said mine shaft, providing at least one ingress point (in this case, the borehole 26) to said area of said mine shaft involved in a fire, proportioning a foam concentrate into a stream of non-flammable liquid to form a stream of foam concentrate/liquid mixture, introducing a gas comprising nitrogen under pressure to said stream of foam concentrate/liquid mixture by a diffuser/dispenser apparatus to expand said foam concentrate in said stream of non-flammable liquid to form a stream of foam fire suppressant, and introducing said stream containing an expanded foam fire suppressant through said at least one ingress point.

One of ordinary skill in the art will recognize that additional configurations are possible without departing from the teachings of the invention or the scope of the claims which follow. This detailed description, and particularly the specific details of the exemplary embodiments disclosed, is given primarily for completeness and no unnecessary limitations are to be imputed therefrom, for modifications will become obvious to those skilled in the art upon reading this disclosure and may be made without departing from the spirit or scope of the claimed invention.

What is claimed is:

1. A method for remotely forming a barrier to seal off a remote chamber, the method comprising the steps of:

a. forming a borehole that communicates between a first location and said remote chamber, said borehole opening to said remote chamber proximate a desired location for said barrier;

b. inserting a conduit through said borehole to extend into said remote chamber;

c. introducing a flowable material through said conduit to said remote chamber and dispensing said flowable material from said conduit to the desired location for said barrier, said flowable material comprising a first resin component and a second activator component, the first and second components of said flowable material upon being dispensed combining to produce a substantially solid, self-sustaining composition;

d. maintaining dispensing said flowable material to produce a sufficient quantity of said self-sustaining composition to form said barrier to seal said remote chamber, while ensuring that said composition does not block said borehole from communicating between said first location and said remote chamber; and e. thereafter removing said conduit to allow access to said borehole.

2. The method according to claim 1, wherein said flowable material is selected from the group consisting of urethane, phenolic, and epoxy foam.

3. The method according to claim 1, wherein said remote chamber is a coal mine passage.

4. A method for remotely forming a barrier to seal off a remote chamber, the method comprising the steps of:

a. forming a borehole that communicates between a first location and said remote chamber, said borehole opening to said remote chamber proximate a desired location for said barrier;

b. inserting a conduit through said borehole to extend into said remote chamber, said conduit comprising a first line for a first component and a second line for a second component, such that said first and second components are maintained separately in said conduit;

c. introducing a flowable material comprised of said first component and said second component through the respective first and second lines of said conduit to said remote chamber and dispensing said flowable material from said conduit to the desired location for said barrier, the first and second components of said flowable material upon being dispensed combining to produce a substantially solid, self-sustaining composition;

d. maintaining dispensing said flowable material to produce a sufficient quantity of said self-sustaining composition to form said barrier to seal said remote chamber, while ensuring that said composition does not block said borehole from communicating between said first location and said remote chamber; and e. thereafter removing said conduit to allow access to said borehole.

5. A method for sealing a coal mine passage, comprising the steps of:

a. forming a borehole that communicates between a first location and a remote chamber within said coal mine passage, said borehole opening to said remote chamber proximate a desired location for a barrier;

b. inserting a conduit through said borehole to extend into said remote chamber, said conduit comprising at least a first line for a first component and a second line for a second component such that said first and the second components are maintained separately in said conduit;

c. introducing a flowable material through said conduit to said remote chamber and dispensing said flowable material from said conduit to the desired location for said barrier within said coal mine passage, said flowable material upon being dispensed producing a substantially solid, self-sustaining composition; and d. maintaining dispensing said flowable material to produce a sufficient quantity of said self-sustaining composition to form said barrier to seal said remote chamber, while ensuring that said composition does not block said borehole from communicating between said first location and said remote chamber.

6. A method for sealing a coal mine passage, comprising the steps of:

a. forming a borehole that communicates between a first location and a remote chamber within said coal mine passage, said borehole opening to said remote chamber proximate a desired location for a barrier;

b. inserting a conduit through said borehole to extend into said remote chamber;

c. introducing a flowable material through said conduit to said remote chamber and dispensing said flowable material from said conduit to the desired location for said barrier within said coal mine passage, said flowable material comprising a first resin component and a second activator component, said first and second components being combined to produce a substantially solid, self-sustaining composition;

d. maintaining dispensing said flowable material to produce a sufficient quantity of said self-sustaining composition to form said barrier to seal said remote chamber, while ensuring that said composition does not block said borehole from communicating between said first location and said remote chamber.

7. The method according to claim 6, wherein said flowable material is selected from the group consisting of urethane, phenolic, and epoxy foam.

8. A method for extinguishing a fire in a mine shaft, comprising the steps of:

a. forming a barrier remotely to seal off an area of said mine shaft involved in the fire and uninvolved areas of said mine shaft comprising the steps of:

1. forming a borehole that communicates between a first location and a remote chamber within said mine shaft, said borehole opening to said remote chamber proximate a desired location for said barrier,
2. inserting a conduit through said borehole to extend into said remote chamber,
3. introducing a flowable material through said conduit to said remote chamber and dispensing said flowable material from said conduit to the desired location for said barrier, said flowable material upon being dispensed producing a substantially solid, self-sustaining composition,
4. maintaining dispensing said flowable material to produce a sufficient quantity of said self-sustaining composition to form said barrier to seal said remote chamber, and
5. thereafter removing said conduit to allow access to said borehole;

b. providing at least one ingress point to said area of said mine shaft involved in the fire;

c. proportioning a foam concentrate into a stream of non-flammable liquid to form a stream of foam concentrate/liquid mixture;

d. introducing a gas comprising nitrogen under pressure to said stream of foam concentrate/liquid mixture by a diffuser/dispenser apparatus to expand said foam concentrate/liquid mixture in said stream of non-flammable liquid to form a stream of foam fire suppressant; and e. introducing said stream of foam fire suppressant through said at least one ingress point.

9. The method according to claim 8, wherein said flowable material comprises a first resin component and a second activator component, said first and second components being combined to produce said substantially solid, self-sustaining composition.

10. The method according to claim 8, wherein said flowable material is selected from the group consisting of urethane, phenolic, and epoxy foam.

11. The method according to claim 8, wherein said conduit comprises a first line for a first component and a second line for a second component, such that said first and second components are maintained separately in said conduit and combined prior to introducing.

* * * * *